United States Patent [19]

Woodson

[11] Patent Number: 4,815,241

[45] Date of Patent: Mar. 28, 1989

[54] WET JET BLAST NOZZLE

[75] Inventor: Jerry P. Woodson, Houston, Tex.

[73] Assignee: Whitemetal Inc., Houston, Tex.

[21] Appl. No.: 933,803

[22] Filed: Nov. 24, 1986

[51] Int. Cl.[4] ..... B24C 5/04

[52] U.S. Cl. ..... 51/439; 51/427; 239/433; 239/591

[58] Field of Search ..... 51/439, 427, 319, 320, 51/321; 239/433, 591

[56] References Cited

U.S. PATENT DOCUMENTS

| | | | |
|---|---|---|---|
| 773,665 | 11/1904 | Murray | 51/439 |
| 2,594,735 | 4/1952 | Crumley | 51/439 |
| 3,994,097 | 11/1976 | Lamb | 51/439 |

FOREIGN PATENT DOCUMENTS

| | | | |
|---|---|---|---|
| 0722464 | 1/1955 | United Kingdom | 51/439 |
| 0865434 | 4/1961 | United Kingdom | 51/439 |

*Primary Examiner*—Frederick R. Schmidt
*Assistant Examiner*—Robert A. Rose
*Attorney, Agent, or Firm*—Dodge, Bush & Moseley

[57] ABSTRACT

In accordance with an illustrative embodiment of the present invention disclosed herein, a liquid propelled blast nozzle apparatus includes a body having first and second bores which receive, respectively, a pressurized flow of sand particles and a high pressure and high velocity flow of propulsion fluid, a nozzle assembly on the body having a third bore for directing a blast of liquid propelled sand particles onto a surface to be cleaned, the respective bores defining axes which intersect one another within the bore of the nozzle assembly, the axis of the first bore intersecting the axis of the third bore at an angle of about $3\frac{1}{2}°$, and the axis of the first bore intersecting the axis of the second bore at an angle of about $7\frac{1}{2}°$. The first and third bores preferably are lined with a suitable wear and erosion resistant material such as tungsten carbide.

18 Claims, 2 Drawing Sheets

WET JET BLAST NOZZLE

FIELD OF THE INVENTION

This invention relates generally to blast nozzles used in cleaning metal surfaces with abrasive particles propelled by a combination of liquid and air, and particularly to a new and improved blast nozzle apparatus having a particular angular relationship between the axes of the abrasive particle and propulsion fluid inlets and the axis of the blast stream outlet that minimizes wear due to erosion to thereby provide a combination of a propulsion chamber and a nozzle with a service life that is substantially increased with respect to prior devices.

BACKGROUND OF THE INVENTION

In order to completely clean a corroded metal surface down to a "white" metal condition so that such surface can be painted to preserve the metal against deterioration, it has become common practice to use various abrasive blasting techniques where particles are propelled against the metal surface in order to dislodge the oxides, previously applied coatings, scale and other contaminants. One cleaning technique has involved a two-step process consisting of dry blasting to apparent white metal, followed by high pressure water blasting to remove contaminants and oxides from microscopic pits in the surface. Another more efficient process has involved a high pressure water jet of the wet jet abrasive blaster type that accelerates abrasive particles against the surface, propelled by both a high pressure, high velocity water jet and air, so that cleaning can be accomplished in a single step. The single step process is preferred because iron oxide "caps" on surface pits which may contain water soluble iron salts do not have sufficient time to form, as in the case of a two-step process, so that the salts are flushed out of the pits to provide a truly clean surface.

In most any water-wetted abrasive blasting operation, the principle problems are slow cleaning rate and early erosion of the nozzle body by abrasive flow, which prevents the maintenance of a stable flow pattern. Erosion and wear within the propulsion chamber or at a point on the outlet nozzle member results in a concentration of the blast of abrasive particles, which will reduce productivity and cause wear through a nozzle body in a relatively short period of time, thus rendering the nozzle inoperative. Although there appears to be no way to prevent erosion and wear altogether in this type of a device, the present invention provides a nozzle design with remarkably reduced wear characteristics compared to prior devices.

The general object of the present invention is to provide a new and improved fluid-propelled abrasive particle blast nozzle that is constructed and arranged to reduce internal erosion and wear to a minimum and thereby greatly increase the service life of the nozzle.

SUMMARY OF THE INVENTION

This and other objects are attained in accordance with the present invention through the provisions of a blast nozzle apparatus comprising a generally cylindrical body having a first inlet bore through which a flow of sand particles under pressure is introduced, and a second inlet bore through which a jet of high pressure and high velocity water is introduced. The axis of the first bore is inclined toward the axis of the second bore so that the propulsion fluid jet impinges on the sand particles in a propulsion zone. An outlet nozzle on the body has an axis having a particular angular relationship to the respective axes of the first and the second inlet bores. In a preferred embodiment, the angle between the outlet bore axis and the liquid propulsion fluid inlet bore axis is 4° plus or minus 1°, and the angle between the outlet bore axis and the sand particle inlet bore axis is 3.5° plus or minus ½°. The angle between the sand inlet axis and the outlet bore axis, hereinafter called the "angle of attack", of approximately 3.5° has been found to produce minimum wear characteristics. It also is preferred to line the sand inlet bore and the outlet nozzle bore with wear tubes made of a material such as tungsten carbide. The sand entrance bore wear tube can be flared at its outer end, and notched on the upper side of its inner end to provide a wall surface at the inner end of the water inlet bore. The inner end face of the liner can be inclined at an angle of 3½° in order to fit flush against an inner end surface of the outlet bore wear liner. The inner end of the outlet wear liner tube also is flared so as to be rigidly positioned within the outlet nozzle member when the member is screwed into the body. It has been found that a blast nozzle apparatus constructed in accordance with the present specification has a surprisingly extended service life compared to prior devices of which applicant is aware. The extended service life maintains a high level of constant productivity to make this type of surface cleaning economically viable.

BRIEF DESCRIPTION OF THE DRAWINGS

The present invention has other objects, features and advantages that will become more clearly apparent in connection with the following detailed description of a preferred embodiment, taken in conjunction with the appended drawings in which.

DETAILED DESCRIPTION OF A PREFERRED EMBODIMENT

Figure 1:
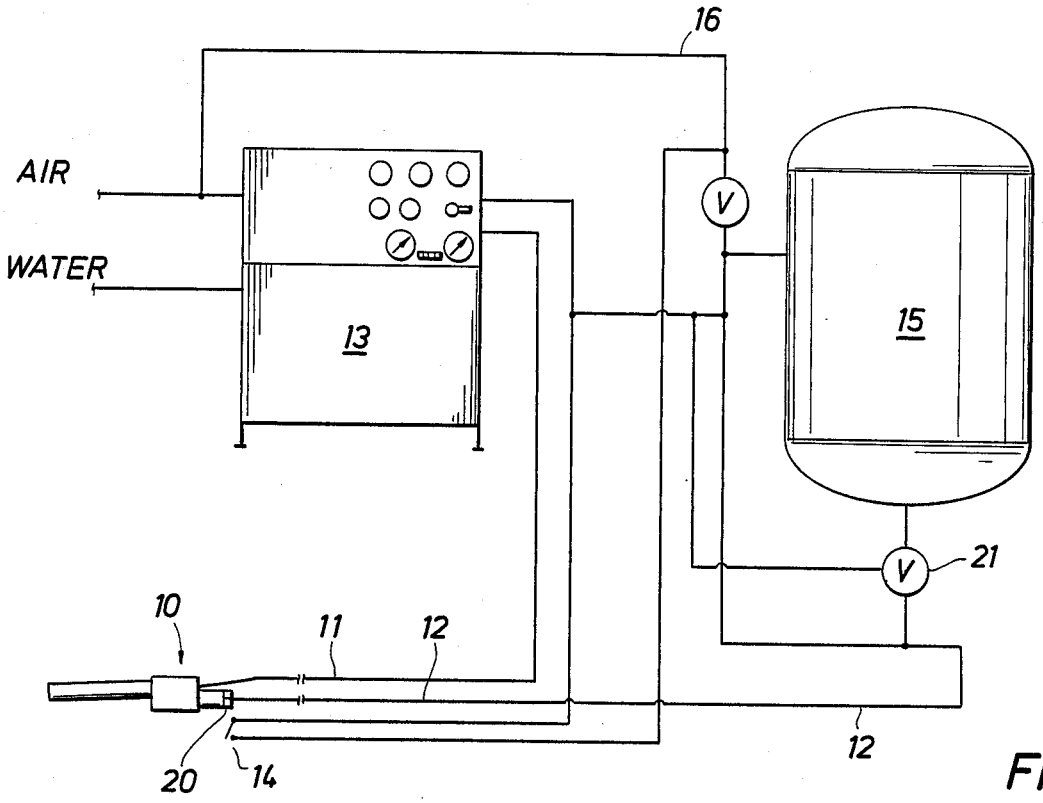
FIG. 1 is a schematic representation of a wet jet blast cleaning system that includes a nozzle apparatus in accordance with the present invention.

Referring initially to FIG. 1, a liquid-propelled blast system includes a nozzle apparatus 10, constructed in accordance with this invention, that is connected to the outer ends of a high pressure water supply hose or line 11 and a blast particle supply hose or line 12. The water line 11 leads to a portable control station 13 that houses a pump and other instrumentation and controls, and may be quite long, for example 250 feet, to enable the operator to conduct cleaning operations a substantial distance away. A normally closed "dead man" control valve 14 is mounted adjacent the nozzle 10 and functions to prevent operation of the nozzle unless the control valve 14 is being held open by depressing a spring-loaded lever.

A supply of abrasive particles, such as #3 sand, is contained in a tank or "pot" 15 which is sized to hold a selected quantity of abrasive, for example 1000 pounds. The tank 15 is pressurized by air pressure from a line 16, and the sand supply hose 12 leads from the tank to the inlet coupling 20 of the nozzle apparatus 10 via a metering and shut-off valve 21. When the valve 21 is opened, a metered amount of sand particles is transported by compressed air through the supply hose 12 to the nozzle 10. The sand particles are impacted and wetted within the nozzle 10 by a high velocity jet of water to produce a high pressure blast that emanates from the nozzle. The blast is directed by the operator in a manner to provide highly effective cleaning of a metal surface. Further details of the control station 13, the sand tank 15, and the various controls, pneumatic and hydraulic circuits by which one or more nozzles can be operated are disclosed and claimed in U.S. patent application Ser. No. 872,095 filed June 6, 1986 which is assigned to the assignee of this invention.

Figure 2:
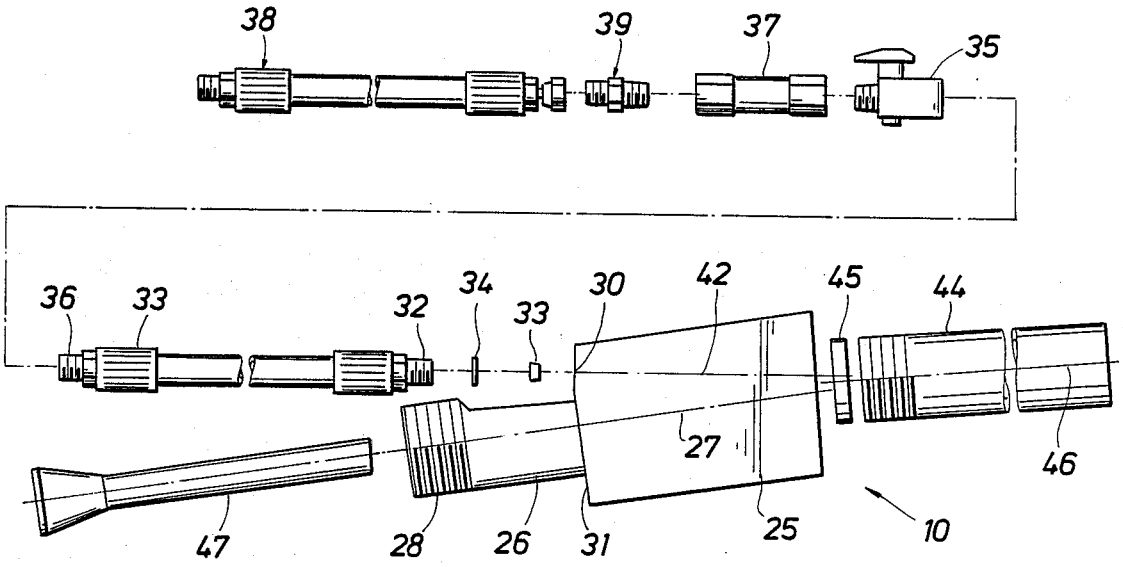
FIG. 2 is an external, exploded view of the various components of the propulsion chamber and nozzle apparatus.

As shown in FIG. 2, the nozzle apparatus 10 includes a generally tubular body 25 having an internal bore and a sand inlet boss 26 that define a first axis 27. The boss 26 is threaded at 28 so that the coupling 20 on the outer end of a sand supply hose 12 can be secured thereto. The upper end surface 30 of the body 25 is inclined with respect to the lower surface 31 at a small angle, and is provided with an internally threaded bore into which the male end 32 of a short length of high pressure hydraulic hose 33 can be connected. As will be described in greater detail below, a nozzle insert 33 is arranged to be received in a tapered seat in the body 25, and a seal ring 34 is provided to prevent fluid leakage. A shut-off valve 35 is connected to the fitting 36 on the end of the hose 33, and a filter sub 37 is connected to the upstream end of the valve 35. A longer length of supply hose 38 is coupled via an adapter 39 to the filter sub 37, and a still longer supply hose (not shown) is connected to the end of the hose 38.

Water under high pressure enters an internal bore in the body 25 that is formed along an axis 42. The outer end of the body 25 has an internally thread counterbore for the reception of the threaded end 43 of an outlet nozzle assembly 44, a gasket 45 being provided to prevent leakage past the threads. The stream of abrasive particles, propelled by both liquid and air, exits the nozzle assembly 44 along an axis 46 which is positioned at selected angles with respect to both of the axes 42 and 27. A tungsten carbide wear liner tube 47 is arranged to be received with in the bore that extends through the boss 26 and into the body 25, and another tubular wear liner tube (not shown in FIG. 2) is received in the bore of the outlet nozzle assembly 44. This liner also is made of a suitable wear resistant material such as tungsten carbide.

Figure 3:
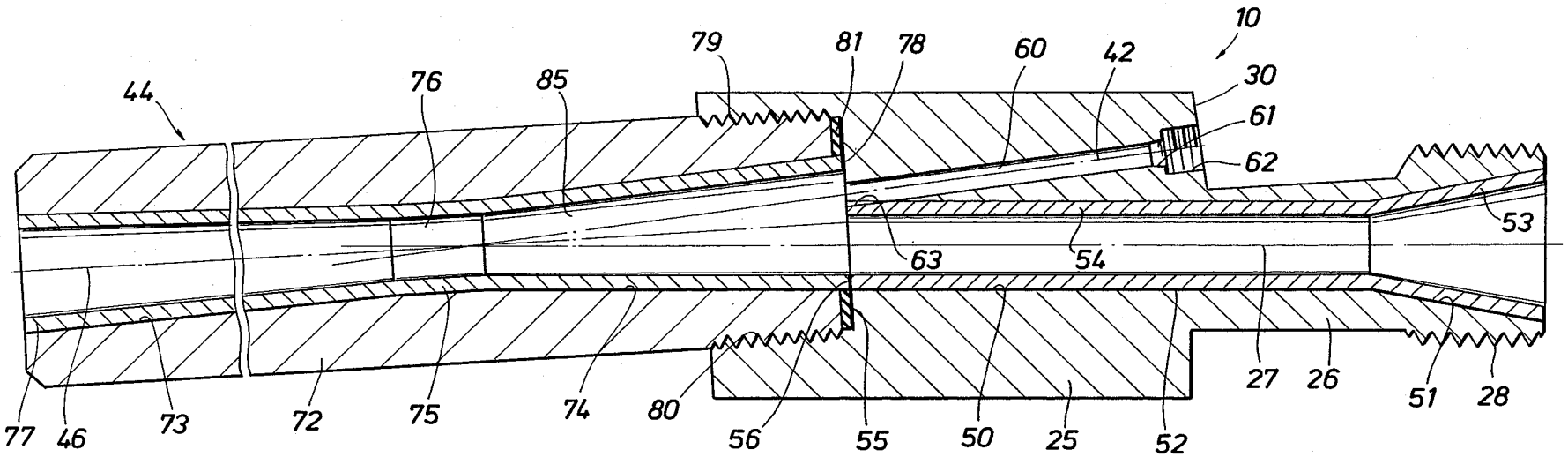
FIG. 3 is a cross-sectional view of the nozzle apparatus of the present invention.

Turning now to FIG. 3 which shows the assembled nozzle apparatus 10 in enlarged cross-section, the body 25 is generally cylindrical in form. The boss 26 is formed integrally as a rearward extension of the body 5, and an upper region of the boss adjacent the end face 30 can be removed, as shown, to provide ample work space for connection of the water supply hose 33. The body 25 and the boss 26 are provided with an internal bore 50 that is conically flared at its outer end section 51. The bore 50 has a longitudinal central axis 27 that defines the path of entry of the flow of abrasive particles and compressed air. The bore 50 preferably is lined with a suitable wear liner, such as tungsten carbide member 51, in the form of a funnel seat, such member having a conical outer portion 53 and a tubular inner portion 54 that terminates at an internal transverse wall 55 in the body 25. The wall 55 is inclined with respect to a perpendicular to the axis 27 by a small angle of about $3\frac{1}{2}°$, and the end face 56 of the wear tube 52 is also inclined so as to terminate flush with the wall 55.

A smaller diameter bore 60 is formed in the body 25 along the axis 42. The bore 60 has a tapered outer end section 61, and a threaded counterbore 62 that receives the threaded end of the short hose 22. The axis 42 forms an angle of about 7.5° with the axis 27, and the lower surface of the bore 60 intersects the upper wall surface of the bore 50 near the wall 55 as shown. To provide a uniform diameter for the bore 60 throughout its length, the upper portion of the inner end of the liner tube 52 is notched at 63.

Figure 4:
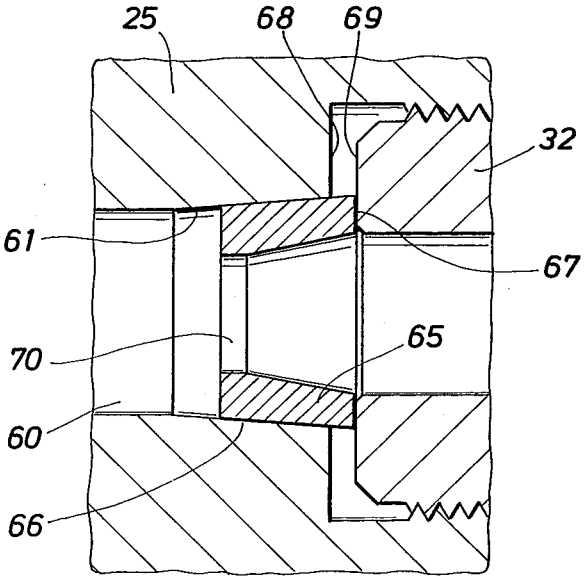
FIG. 4 is an enlarged, fragmentary view of the nozzle insert structure that produces a high velocity jet of propulsion fluid.

Water under high pressure enters the bore 60 through a nozzle insert 65 as shown in FIG. 4. The insert 65 has an outer surface 66 that is conically tapered on an angle of about 5°, and which is sized to fit within the tapered bore 61 in a manner such that the insert is snug with the bore before the outer end face 67 is flush with the wall 68. Thus the outer end face 69 of the fitting 32 can abut against the insert as the fitting is made up in order to force the insert into the taper 61 and provide a leak-proof metal-to-metal seal. As shown, the insert 65 has a reduced diameter throat area 70, whereby high pressure water is formed into a jet of very high velocity which passes through the bore 60 on axis 42.

The outlet nozzle assembly 44 includes a tube 72 with a central bore 73 having a longitudinal central axis 46. The inner end section of the bore 72 is flared outwardly somewhat in the region 74, and receives a tungsten carbide wear liner tube 75 in the form of a venturi. The liner tube 75 has a reduced diameter throat region 76, and the bore thereof tapers slightly outwardly toward the outer end 77 thereof, and has a faster taper, as shown, toward the inner end 78 thereof. As shown in FIG. 3, the inner bore of the wear liner 54 is in substantial alignment with inlet taper 74 of wear liner 75, and also is in substantial alignment with outlet taper of upper surface of section 77 of liner 75. Thus a non-expanding flow of abrasive particles from the bore of wear liner 54 passes through throat 76 without reaching the outer diameter of liner 75 at any point along its length. The nozzle tube 72 is provided with external threads 79 which are secured to internal threads in a counterbore 80 in the front end of the body 25. A suitable seal ring 45 is compressed between the end face 82 of the tube 72 and the wall 55 as the tube is made up to prevent fluid leakage past the threads 79. Tube 72 and tube 75 have a concentric axis 46.

The longitudinal central axis 46 of the tubes 72 and 75 is aligned at a particular angle with respect to the axis 27 in accordance with an important aspect of the present invention. In the preferred embodiment, the angle between the axis 46 and the axis 27 is about 3.5°, and the angle between the axis 46 and the axis 42 is about 4°. Thus, the angle between the axes 27 and 42 is about 7.5°. Applicant has found that with this particular arrangement of axes, there is a remarkable reduction in internal erosion and wear of the nozzle 10 so that the service life of the nozzle is greatly increased with respect to other designs. For example, the nozzle design of the present invention can be expected to last for several months of normal usage without developing any severe wear patterns that are sufficient to de-establish the effectiveness of the blast flow.

OPERATION

In operation the nozzle assembly 10 is assembled as shown in the drawings, and the blast particle supply hose 12 and the water supply hose are hooked up to the inlet boss 26 and the water inlet thread 62, respectively. The fitting 32 on the hose 33 is tightened sufficiently to firmly seat the nozzle insert 65 in the tapered bore 61. When the operator depresses the lever on the dead-man control valve 14, a pump within the control station 13 begins to supply high pressure water to the hose 11, and the metering valve 21 automatically opens so that a metered flow of abrasive particles is supplied to the nozzle 10 via the hose 12. A jet of high velocity water emanating from the insert 65 impinges against the abrasive particles in the propulsion chamber 85 and wets and accelerates the abrasive particles to a higher velocity than would be provided by the compressed air alone.

The wet abrasive flow blasts the surface of the metal being cleaned, and removes substantially all rust, scale, salt contamination and hydroxides, even from microscopic pits in the metal surface to provide extremely efficient cleaning down to white metal. The present invention typically uses less sand than dry blasters, or other forms of wet blasters, and uses 1/10 to ⅓ as much water as other forms of wet blasters, thus requiring less chemical additive to prevent flash rust and producing less water runoff, leaving relatively little clean-up after the operation is performed. Cleaning of the metal surface is performed in a single step process, as opposed to prior devices that consist of dry blasting, followed by high pressure water blasting. In a single-step process, there is insufficient time for the reforming of oxides as in the case of the two-step process, thus resulting in a technologically superior surface cleanliness.

The particular angle of attack about 3½° between the axis of the sand flow path and the path of the outlet blast has been found to reduce nozzle wear due to erosion to a very minimum. This angle of attack is created, as explained above, by impinging the jet of propulsion liquid on the sand flow stream at an angle of about 4° to the exit axis within the propulsion chamber. The effect is to redirect the flow of abrasive particles by an angle of about 3½° to be parallel to the exit axis 46.

It now will be recognized that a new and improved wet blast cleaning nozzle apparatus has been disclosed. Certain changes or modifications may be made in the disclosed embodiment without departing the inventive concepts involved. For example, body 25 and tube 72 could be made from one piece, thus eliminating threads 79, 80 and seal ring 45. It is the aim of the appended claims to cover all such changes and modifications falling within the true spirit and scope of the present invention.

What is claimed is:

1. Liquid propelled abrasive cleaning apparatus comprising: a generally tubular body having a first bore formed therein for receiving a flow of blast particles, said first bore having a first longitudinal axis, said body having a second bore formed therein for receiving a propulsion fluid under high pressure and at high velocity and directing such fluid against said blast particles, said second bore having a second longitudinal axis that intersects said first axis; and an outlet nozzle on said body for delivering blast particles propelled by said fluid against a surface to be cleaned, said outlet nozzle having a third longitudinal axis, said first, second, and third longitudinal axes intersecting at a common point in said outlet nozzle, said first axis being inclined with respect to said third axis at an angle of about 3.5°, and wherein said second bore has an entrance end portion formed by a frusto-conical surface, and further including a nozzle insert having a frusto-conical outer surface, said nozzle insert being positioned in said entrance end portion with the outer end face thereof extending outwardly beyond the entrance end of said second bore.

2. The apparatus of claim 1 wherein the angle between said first axis and said second axis is about 7.5°.

3. The apparatus of claim 2 wherein said body has a counterbore in the front end thereof, said outlet nozzle having a rear portion that is fixed within said counterbore, and further including a wear liner tube positioned within said outlet nozzle and extending throughout the length thereof, said tube defining a third axis lying in the same plane as said first and second axes.

4. The apparatus of claim 3 wherein said wear liner tube has a reduced diameter throat region between the ends thereof, said throat region being located a distance from said rear portion such that the point of intersection of said first, second and third axes are within said throat region.

5. The apparatus of claim 4 wherein said first bore in said body is provided with a liner made of wear resistant material that extends inwardly of said body into alignment with an end surface of said first-mentioned wear liner tube.

6. The apparatus of claim 1 further including means operable upon connection of a water supply fitting to said entrance end for applying axial inward force to said insert to ensure a leak-proof fit of said insert in said end portion and to provide positive axial alignment of the high velocity water stream along said second axis.

7. The apparatus of claim 6 wherein said force applying means includes a female thread on said entrance end portion, and fitting means having a male thread adapted to be screwed into said female thread, said fitting means having a front end face arranged to engage the outer end face of said insert as said male and female threads are made up.

8. The apparatus of claim 5 further including notch means in an outer end surface of said liner that forms a portion of the wall surface of said second bore.

9. The apparatus of claim 8 wherein the inner end face of said liner is inclined with respect to a perpendicular to said first axis at an angle of about 3.5°.

10. Liquid propelled abrasive cleaning apparatus comprising: a generally tubular body having a first bore formed therein for receiving a pressurized flow of abrasive particles, said first bore defining a first axis; a second bore in said body for receiving a propulsion fluid under high pressure and at high velocity, said second bore defining a second axis that intersects said first axis and is inclined with respect thereto at an angle of about 7.5°; nozzle means on said body having a third bore for directing abrasive particles propelled by said fluid against a surface to be cleaned, said nozzle means having a third axis that intersects said first and second axes at a common point, said axes all lying in the same plane, the angle of said third axis with respect to said first axis being about 3.5°, and the angle of said third axis with respect to said first axis being about 4°.

11. The apparatus of claim 10 wherein said common point of intersection of said axes is within the bore of said nozzle means.

12. The apparatus of claim 11 including a first wear liner tube positioned within said third bore and extending throughout the length of said nozzle means, said first liner tube having a flared inner end section that leads to a reduced diameter throat section thereof.

13. The apparatus of claim 12 wherein said common point of intersection is within said throat section.

14. The apparatus of claim 11 wherein said first bore has a second wear liner tube positioned therein, said second liner tube extending inwardly of said body by a distance such that an end surface thereof is adjacent an inner end surface of said first wear liner tube.

15. The apparatus of claim 10 wherein said second bore has an entrance end portion formed by a frusto-conical surface, and further including a nozzle insert having a tapered outer surface received in said end portion for forming a jet of high velocity propulsion fluid within said second bore.

16. The apparatus of claim 15 further including means operable upon connection of a liquid supply means to the inlet of said second bore for forcing said insert into said entrance end portion to prevent fluid leakage past said frusto-conical surface.

17. The apparatus of claim 16 wherein said insert has an axial length such that when said insert is seated against said frusto-conical surface the outer end face of said insert is located outwardly of said frusto-conical surface, said forcing means comprising an end surface on a liquid supply fitting that is arranged to engage said outer end face and apply inwardly directed force thereto as said fitting is made up to said body.

18. The apparatus of claim 17 wherein said body includes an outwardly extending boss through which a portion of said first bore extends, said boss having connection means therein to which an abrasive particle supply line can be coupled.

* * * * *